US009265115B1

(12) United States Patent
Dunn et al.

(10) Patent No.: US 9,265,115 B1
(45) Date of Patent: Feb. 16, 2016

(54) ILLUMINATED DOORWAY WARNING SYSTEM AND METHOD

(71) Applicants: Otto W Dunn, Leawood, KS (US); Kipton Dunn, Leawood, KS (US)

(72) Inventors: Otto W Dunn, Leawood, KS (US); Kipton Dunn, Leawood, KS (US)

( * ) Notice: Subject to any disclaimer, the term of this patent is extended or adjusted under 35 U.S.C. 154(b) by 0 days.

(21) Appl. No.: 14/210,270

(22) Filed: Mar. 13, 2014

Related U.S. Application Data

(60) Provisional application No. 61/780,035, filed on Mar. 13, 2013.

(51) Int. Cl.

| | |
|---|---|
| ***F21S 8/00*** | (2006.01) |
| ***H05B 33/08*** | (2006.01) |
| ***H05B 37/02*** | (2006.01) |
| ***F21V 33/00*** | (2006.01) |

(52) U.S. Cl.
CPC ..... *H05B 33/0854* (2013.01); *F21V 33/0076* (2013.01); *H05B 37/0227* (2013.01)

(58) Field of Classification Search
CPC ..... G08B 7/062; G08B 7/066; G08B 17/00; H05B 37/029; H05B 37/0272; H05B 33/0869
USPC ..... 315/312, 149, 152, 153; 340/506, 517, 340/577, 628; 362/351, 152, 153, 84
See application file for complete search history.

(56) References Cited

U.S. PATENT DOCUMENTS

| | | | | |
|---|---|---|---|---|
| 6,646,545 | B2 * | 11/2003 | Bligh | 340/286.05 |
| 6,873,256 | B2 * | 3/2005 | Lemelson | G08B 7/066 340/511 |
| 7,125,136 | B1 * | 10/2006 | Dedic | E06B 1/52 362/152 |
| 8,376,567 | B1 * | 2/2013 | Zozula et al. | 362/147 |
| 2010/0188023 | A1 * | 7/2010 | Anderson et al. | 315/312 |

* cited by examiner

*Primary Examiner* — Haissa Philogene
(74) *Attorney, Agent, or Firm* — Polsinelli PC; Adam C. Rehm

(57) ABSTRACT

A system and method to illuminate an emergency exit pathway during an event is provided. The system includes a receiver in communication with a transmitter, a lighting device wired to the receiver, and a power source configured to power the lighting device and the receiver. The transmitter is configured to communicate a signal indicative of an even to the receiver. The event is an emergency event requiring evacuation of a space. The space is an enclosed space. The lighting device surrounds at least a portion of an exit for the space and is configured to emit light and illuminate the portion of the exit when the signal is received by the receiver. The lighting device is a plurality of light emitting diodes arranged along at least three sides of the exit The power source is a battery pack.

16 Claims, 2 Drawing Sheets

1
5
10
5
20
25
25
30

ILLUMINATED DOORWAY WARNING SYSTEM AND METHOD

CROSS-REFERENCE TO RELATED APPLICATION

This Patent Application claims priority to U.S. Provisional Patent Application Ser. No. 61/780,035 titled ILLUMINATED DOORWAY WARNING SYSTEM AND METHOD, and filed Mar. 13, 2013, the entire contents of which are herein incorporated by reference in its entirety.

BACKGROUND

1. Field

A system and method to illuminate an emergency exit pathways.

2. Discussion of Related Art

There is a demand to ever increase efficiency when evacuating a space during an emergency.

SUMMARY OF THE INVENTION

Systems and methods consistent with the present inventive concept provide increased efficiency when evacuating a space during an emergency.

It is an objective of the present inventive concept to provide a system which will illuminate an entire door frame with LED lights during a fire or any type of a controlled evacuation. Fire and Smoke Emergencies are the primary utilizations for the present inventive concept. Use of LEDs in the present inventive concept is preferred, however, other lighting systems could be used. The present inventive concept is configured to light a door frame once a Fire Alarm is system triggered in a commercial or residential building. The present inventive concept is to complement existing systems as well as be part of new builds. The present inventive concept can be added to an existing system, e.g., retrofit, within any structure as long as there is a power source, battery or hard wired. The lights on the door frame line the entire frame from the floor on both sides to the top and across the top of the frame. A series of doors within one building would lead people to an exterior door, leading them to safety using green lights on one side of the door frame, i.e., lights configured to emit light having a wavelength between 495-570 nm. Red lights, i.e., lights configured to emit light having a wavelength between 620-750 nm on the opposite side of the same door frames would prevent individuals from moving to interior section of a building, which potentially could cause them harm. The lights can be controlled in sections if the building is large enough. A wireless option will be available as well to insure all methods of providing power to the lights are provided.

It is an objective of the present inventive concept to provide a system which will provide an exit or doorframe lined in lights so someone trying to escape on their knees, someone in heavy smoke or the visually impaired will have a better chance of seeing the way out. Also, having a color coded path leading people to safety based on common colors aligned with the universally recognized color of danger-red and the color of go-green. The system can be placed in new buildings as systems are being placed installed or retro-fitted to tie into existing systems to enhance them. One other advantage to a system like this is the unique feature can be retro fitted into an existing system either hard-wired or with a wireless system.

The aforementioned may be achieved in one aspect of the present inventive concept by providing a system to illuminate an emergency exit pathway. The system may include a receiver in communication with a transmitter, the transmitter configured to receive a signal indicative of an event and communicate the signal to the receiver, the signal may be originated by a smoke detector, the event being an emergency event requiring evacuation of a space, the space being an enclosed space; at least one lighting device wired to the receiver, the device surrounding at least a portion of an exit for the space and configured to emit light and illuminate the portion of the exit when the signal is received by the receiver, the device being a plurality of light emitting diodes arranged along at least three sides of the exit; and/or a power source configured to power at least one of the device and the receiver, the power source being a battery pack.

The aforementioned may be achieved in another aspect of the present inventive concept by providing a method to illuminate an emergency exit pathway. The method may include the steps of receiving a signal via a receiver in communication with a transmitter, the transmitter configured to receive the signal indicative of an event and communicate the signal to the receiver, the signal may be originated by a smoke detector, the event being an emergency event requiring evacuation of a space, the space being an enclosed space; illuminating at least a portion of an exit via at least one lighting device wired to the receiver, the device surrounding the portion of the exit for the space and configured to emit light when the signal is received by the receiver, the device being a plurality of light emitting diodes arranged along at least three sides of the exit; and powering at least one of the device and the receiver via a power source configured to power, the power source being a battery pack.

Other systems, methods, features, and advantages of the present inventive concept will be or will become apparent to one with skill in the art upon examination of the following figures and detailed description. It is intended that all such additional systems, methods, features, and advantages be included within this description, be within the scope of the present inventive concept, and be protected by the accompanying claims.

BRIEF DESCRIPTION OF THE DRAWINGS

The accompanying figures, which are incorporated in and constitute a part of this specification, illustrate an implementation of the present inventive concept and, together with the description, serve to explain the advantages and principles of the present inventive concept. In the figures.

The figures do not limit the present inventive concept to the specific examples disclosed and described herein and are not necessarily to scale.

DETAILED DESCRIPTION OF THE INVENTION

The following detailed description references the accompanying figures that illustrate the present inventive concept. The illustrations and description are intended to describe aspects of the present inventive concept in sufficient detail to enable those skilled in the art to practice the present inventive concept. Other components can be utilized and changes can be made without departing from the scope of the present inventive concept. The following detailed description is, therefore, not to be taken in a limiting sense. The scope of the present inventive concept is defined only by the appended claims, along with the full scope of equivalents to which such claims are entitled.

In this description, references to an "embodiment" or "embodiments" mean that the feature or features being referred to are included in at least one embodiment of the present inventive concept. Separate references to an "embodiment" or "embodiments" do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present inventive concept can include a variety of combinations and/or integrations of the embodiments described herein.

Figure 1:
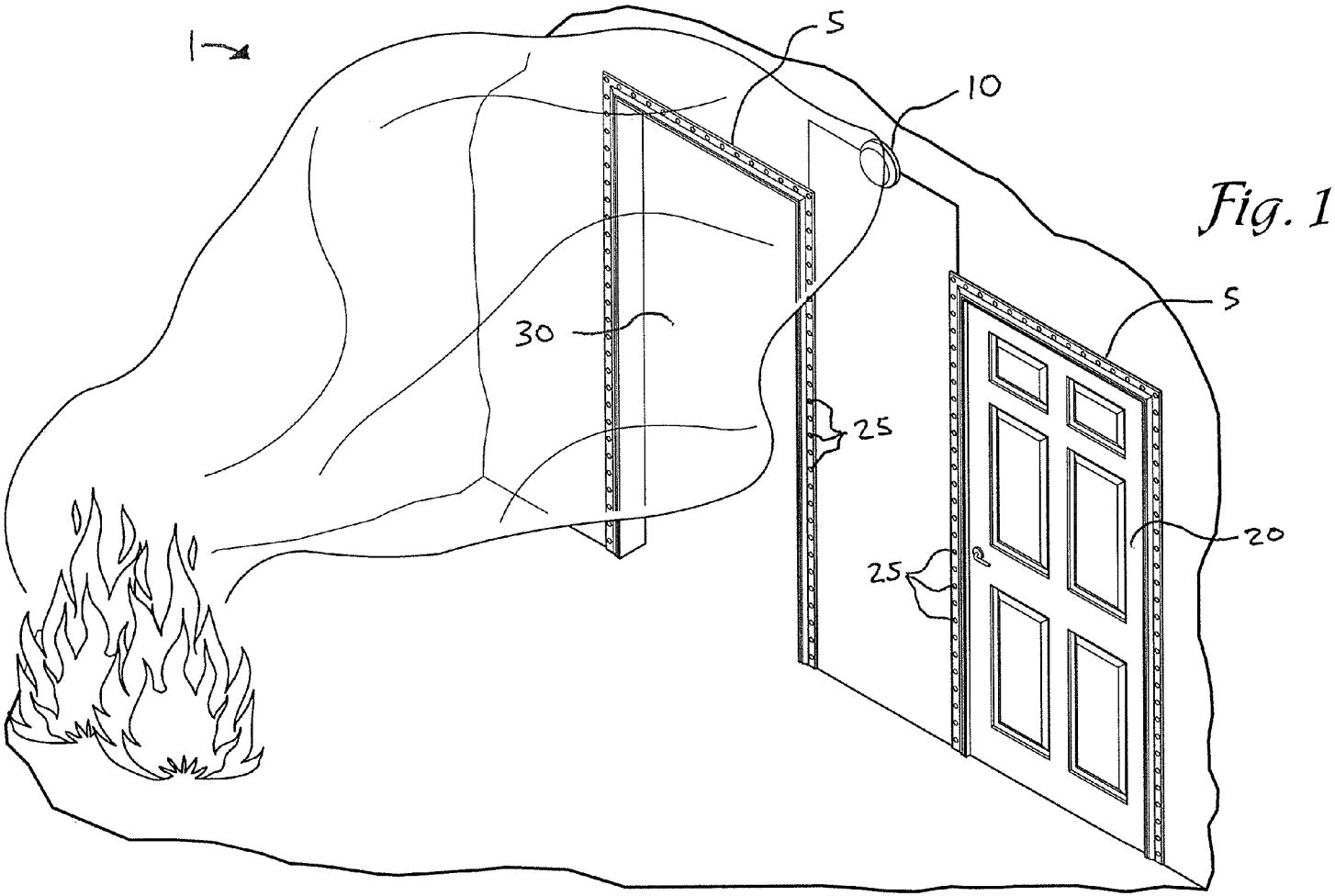
FIG. 1 is a view of an exemplary embodiment consistent with the present inventive concept.
Figure 2:
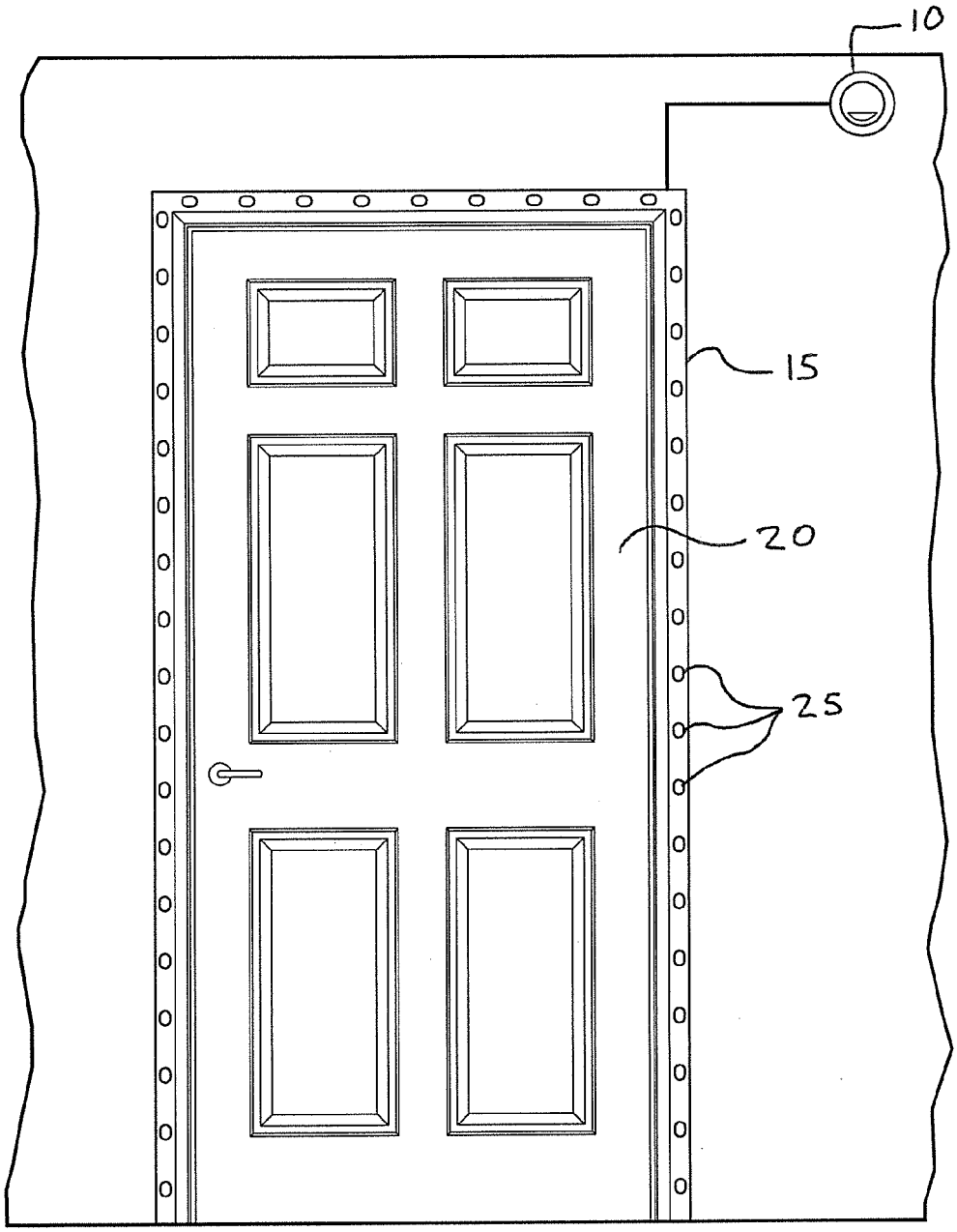
FIG. 2 is a view of an exemplary embodiment consistent with the present inventive concept.

Turning to FIGS. 1 and 2, a system 1 to illuminate an emergency exit pathway is illustrated. The system 1 may include a receiver 5 or antenna in communication with a transmitter or smoke detector 10. The transmitter is configured to generate a signal indicative of an event, e.g., the presence of smoke, and wirelessly communicate the signal to the receiver. The event is an emergency event requiring evacuation of a space near or proximate to the transmitter, e.g., an enclosed space or room.

At least one lighting device 15 is wired to the receiver 5 and surround a portion of an exit 20 for the space and configured to emit light and illuminate the portion of the exit when the signal is received by the receiver. The device is a plurality of light emitting diodes 25 arranged along at least three sides of the exit. A power source or battery is configured to power at least one of the device 15 and the receiver 5. As illustrated in FIG. 1, the exit 20 is configured to illuminate with green ones of the light emitting diodes 25 while a non-exit 30 is configured to illuminate with red ones of the light emitting diodes 25. In this manner, the present inventive concept helps direct people to an exterior door, leading them to safety using green lights, and helps deter people from moving to an interior section of a building, which potentially could cause them harm if it is necessary to immediately exit the building to avoid harm.

Accordingly, the present inventive concept provides a system and method to illuminate an emergency exit pathway during an event.

The foregoing description of an implementation of the invention has been presented for purposes of illustration and description. It is not exhaustive and does not limit the invention to the precise form disclosed. Modifications and variations are possible in light of the above teachings or may be acquired from practicing the invention. Accordingly, while various embodiments of the present invention have been described, it will be apparent to those of skill in the art that many more embodiments and implementations are possible that are within the scope of this invention. Accordingly, the present invention is not to be restricted except in light of the attached claims and their equivalents.

I claim:

1. A system to illuminate an emergency exit pathway for a user via a plurality of different color codes, said system comprising:

a receiver in communication with a transmitter, the transmitter configured to communicate a signal indicative of an event to the receiver, the event being an emergency event requiring evacuation of an enclosed space; and at a plurality of lighting devices wired to the receiver, each of the devices (i) surrounding at least a portion of a doorway of the enclosed space, (ii) configured to emit light and illuminate the portion of the doorway when the signal is received by the receiver to illuminate the emergency exit pathway, and (iii) being a plurality of light emitting diodes arranged along at least three sides of the doorway, wherein, a first one of the plurality of lighting devices is (i) arranged on a first doorway side, and (ii) configured to indicate an interior of the enclosed space by emitting red light, and a second one of the plurality of lighting devices is (i) arranged on a second doorway side, and (ii) configured indicate an exterior of the enclosed space by emitting green light.

2. The system of claim 1, wherein the system is retrofittable to a preexisting system to enhance functionality of the preexisting system.

3. The system of claim 1, wherein the first one of the plurality of lighting devices is configured to emit light having a wavelength between 620-750 nm.

4. The system of claim 1, wherein the second one of the plurality of lighting devices is configured to emit light having a wavelength between 495-570 nm.

5. The system of claim 1, wherein the first and second ones of the plurality of lighting devices are configured to cooperate with each other to form a pathway that leads the user away from the interior of the enclosed space.

6. The system of claim 1, wherein the first and second ones of the plurality of lighting devices are configured to cooperate with each other to form a pathway that deters the user from moving to an interior of the enclosed space by emitting universally-recognized colors.

7. The system of claim 1, wherein the first and second ones of the plurality of lighting devices are configured to cooperate with each other to form a pathway that leads the user to an exterior of the enclosed space.

8. The system of claim 1, wherein the first and second ones of the plurality of lighting devices are configured to cooperate with each other to form a pathway that leads the user to safety.

9. A method to illuminate an emergency exit pathway for a user via a plurality of different color codes, said method comprising the steps of:

receiving a signal via a receiver in communication with a transmitter, the transmitter configured to communicate a signal indicative of an event to the receiver, the event being an emergency event requiring evacuation of an enclosed space;

illuminating at least a portion of a doorway of the enclosed space via a plurality of lighting devices wired to the receiver, each of the devices (i) surrounding the portion of the doorway, (ii) configured to emit light when the signal is received by the receiver to illuminate the emergency exit pathway, and (iii) being a plurality of light emitting diodes arranged along at least three sides of the doorway, wherein, a first one of the plurality of lighting devices is (i) arranged on a first doorway side, and (ii) configured to indicate an interior of the enclosed space by emitting red light, and a second one of the plurality of lighting devices is (i) arranged on a second doorway side, and (ii) configured indicate an exterior of the enclosed space by emitting green light.

10. The method of claim 9, wherein the first one of the plurality of lighting devices is configured to light having a wavelength between 620-750 nm.

11. The method of claim 9, wherein the second one of the plurality of lighting devices is configured to emit light having a wavelength between 495-570 nm.

12. The method of claim 9, wherein the first and second ones of the plurality of lighting devices are configured to cooperate with each other to form a pathway that leads the user away from the interior of the enclosed space.

13. The method of claim 9, wherein the first and second ones of the plurality of lighting devices are configured to cooperate with each other to form a pathway that deters the user from moving to an interior of the enclosed space by emitting universally-recognized colors.

14. The method of claim 9, wherein the first and second ones of the plurality of lighting devices are configured to cooperate with each other to form a pathway that leads the user to an exterior of the enclosed space.

15. The method of claim 9, wherein the first and second ones of the plurality of lighting devices are configured to cooperate with each other to form a pathway that leads the user to safety.

16. The method of claim 9, wherein the system is retrofittable to a preexisting system to enhance functionality of the preexisting system.

* * * * *